US012758828B1

(12) United States Patent
Lee

(10) Patent No.: US 12,758,828 B1
(45) Date of Patent: Oct. 13, 2026

(54) STACKABLE TREE STICKS

(71) Applicant: AVID STRATEGIC LLC, Frankenmuth, MI (US)

(72) Inventor: Scott Lee, Frankenmuth, MI (US)

(73) Assignee: AVID STRATEGIC LLC, Frankenmuth, MI (US)

( * ) Notice: Subject to any disclaimer, the term of this patent is extended or adjusted under 35 U.S.C. 154(b) by 0 days.

(21) Appl. No.: 19/442,879

(22) Filed: Jan. 7, 2026

(51) Int. Cl.
*A63B 27/00* (2006.01)

(52) U.S. Cl.
CPC ..... *A63B 27/00* (2013.01)

(58) Field of Classification Search
CPC . A63B 27/00; E06C 1/34; E06C 1/381; E06C 7/08; A01M 31/02; A01M 31/00
See application file for complete search history.

(56) References Cited

U.S. PATENT DOCUMENTS 11,198,038 B1 12/2021 Power, II et al.
11,808,085 B2 * 11/2023 Power, II ..... A63B 27/00
12,427,378 B2 9/2025 Lee
2018/0073298 A1 * 3/2018 Hand ..... E06C 1/381
2023/0398409 A1 * 12/2023 Schofield ..... A63B 27/00
2024/0200040 A1 6/2024 An et al.
2024/0200406 A1 * 6/2024 Hanshaw ..... A01M 31/02
2025/0032858 A1 * 1/2025 Lee ..... A63B 27/00
2026/0022610 A1 * 1/2026 Ferguson ..... E06C 1/34

* cited by examiner

*Primary Examiner* — David E Martinez
(74) *Attorney, Agent, or Firm* — Robert L. Stearns; Dickinson Wright PLLC

(57) ABSTRACT

An improved tree-climbing stick includes an elongated central post with an upper step and a lower step, and upper and lower standoff brackets each having laterally spaced jaws configured to cradle a tree trunk. The standoff brackets are dimensioned to nest with like brackets of a second, identical stick so that, in a nested condition, the posts and steps of the sticks are disposed in substantial longitudinal alignment without increasing effective end-to-end length. Complementary linking features carried by the jaws of at least one of the standoff brackets are operative, when the jaws of two sticks are nested, to releasably lock the sticks together while maintaining minimal lateral spacing between their respective posts, thereby forming a compact, low-profile stack suitable for transport.

10 Claims, 9 Drawing Sheets

STACKABLE TREE STICKS

BACKGROUND

1. Technical Field

The present disclosure relates to tree sticks used by hunters to climb a tree, and more particularly to tree sticks that are stackable for effective transport and secure nesting.

2. Related Art

Saddle hunters and other outdoor enthusiasts often use portable tree-climbing sticks to access elevated positions in trees for observation or hunting. They typically carry their equipment to and from the woods over long distances and the weight and bulk of the gear significantly affect the overall comfort and enjoyment of the activity. Existing tree sticks are typically bundled together using external straps or carriers, which can result in uneven weight distribution, increased noise, and potential snagging of tree and underbrush during transport through the woods and over rugged terrain. Furthermore, these methods often fail to maintain proper alignment of the sticks, leading to cumbersome handling, time-consuming setup, and potential safety risks during use. Some tree sticks incorporate interengaging features to couple with like sticks; however, they often rely on additional components and/or arrange the sticks in a sub-optimal, non-compact configuration. The lack of an integrated solution for compactly and securely organizing multiple tree sticks has been a persistent challenge in the field.

SUMMARY

The present disclosure addresses these shortcomings by introducing a tree stick design that incorporates innovative features for in-line stackability and secure nesting. The described concept enables multiple tree sticks to be detachably locked together in a compact, low-profile stack, minimizing lateral spacing between adjacent sticks and ensuring their posts and steps remain in substantial longitudinal alignment. This is achieved through the integration of complementary linking features on the standoff brackets of each stick. These linking features according to an embodiment may include a detent and a cooperating protrusion, at least one of which is resilient, allowing for a snap-fit engagement that securely connects the sticks while facilitating quick assembly and disassembly. Additionally, guiding ribs and channels may be incorporated to ensure precise alignment during nesting, further enhancing the ease of use and reliability of the system.

A method is also provided for preparing a plurality of tree-climbing sticks for transport, with each stick including an elongated central post extending between an upper end and a lower end, an upper step and a lower step fixed to the post, and an upper and lower standoff brackets mounted on the post and each including a pair of laterally spaced jaws carrying complementary releasably interengageable linking formations. The method includes positioning a first stick with the jaws of one of the standoffs oriented to receive the jaws of a second stick and inserting the jaws of the second stick between the jaws of the first stick until the linking formations of the two sticks releasably interengage to detachably secure the first and second stick together in a nested condition in which the upper and lower ends of the posts and the steps of the nested sticks disposed in substantial longitudinal alignment.

By eliminating the need for external straps or carriers and providing a streamlined stacking mechanism, the described system significantly improves portability, reduces noise, and enhances the overall user experience. The robust and weather-resistant design ensures durability in outdoor environments, while the compact stacking configuration simplifies transport and deployment, enabling users to access elevated positions with greater efficiency and safety. This approach represents a substantial advancement over existing solutions, addressing long-standing challenges in the domain of portable tree-climbing aids.

In-line stacking does not increase the effective end-to-end length of the sticks when nested; the stacked assembly advantageously remains the same or substantially the same length as an individual stick. This yields a more compact, transportable, and packable configuration, while presenting a refined, attractive, and clean appearance.

In-line stacking is achieved without adding dedicated connecting components. The existing standoff brackets are reconfigured to nest in-line and include interlocking portions that releasably lock the brackets together when nested. Eliminating extra parts reduces weight and bulk, while the redesigned standoff brackets provide a clean, efficient approach to interconnecting the sticks.

THE DRAWINGS

These and other features and advantages will become better understood when considered in connection with the following detailed description and drawings, in which.

DETAILED DESCRIPTION

Figure 1:
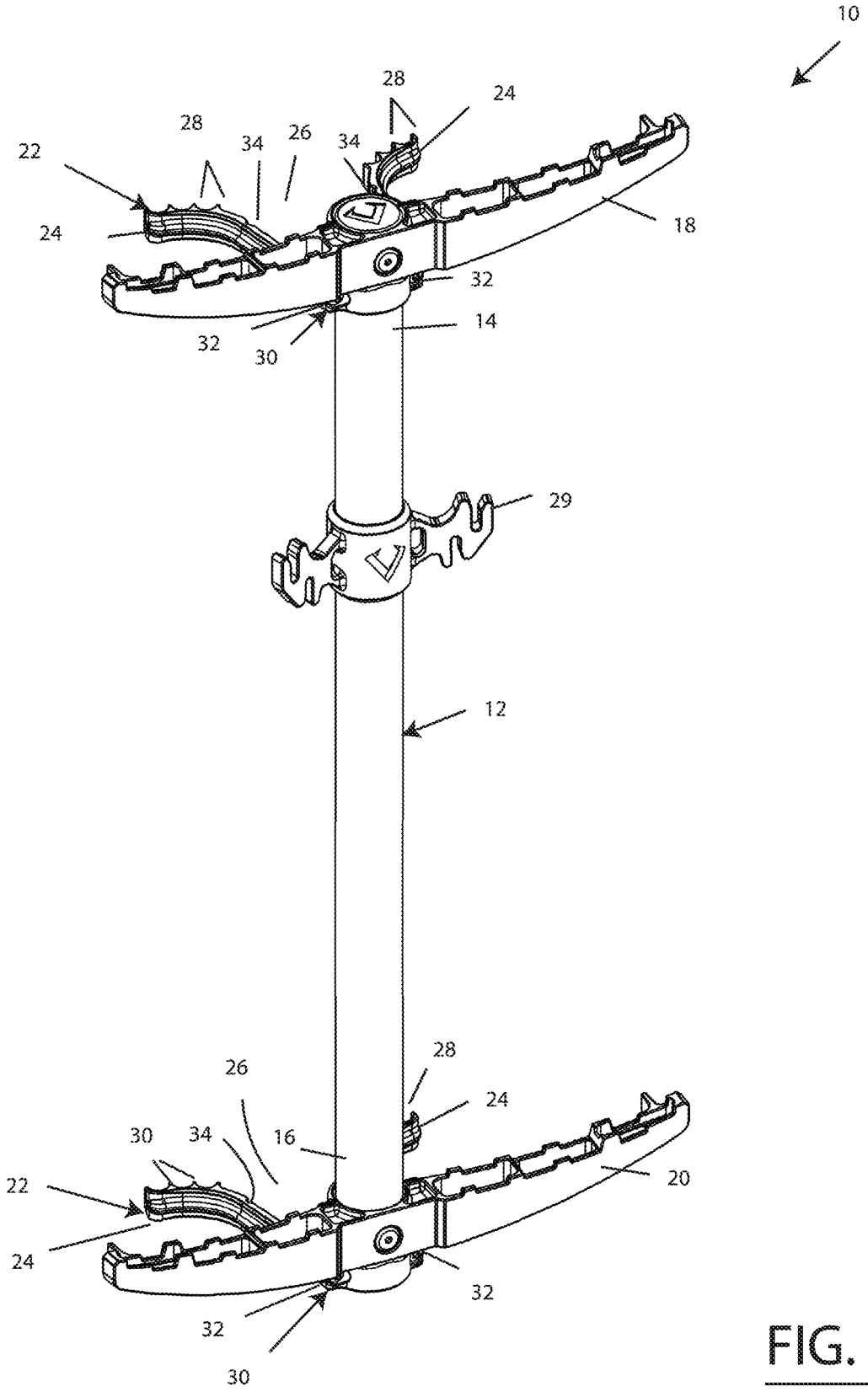
FIG. 1 is a perspective view of a tree stick.
Figure 2:
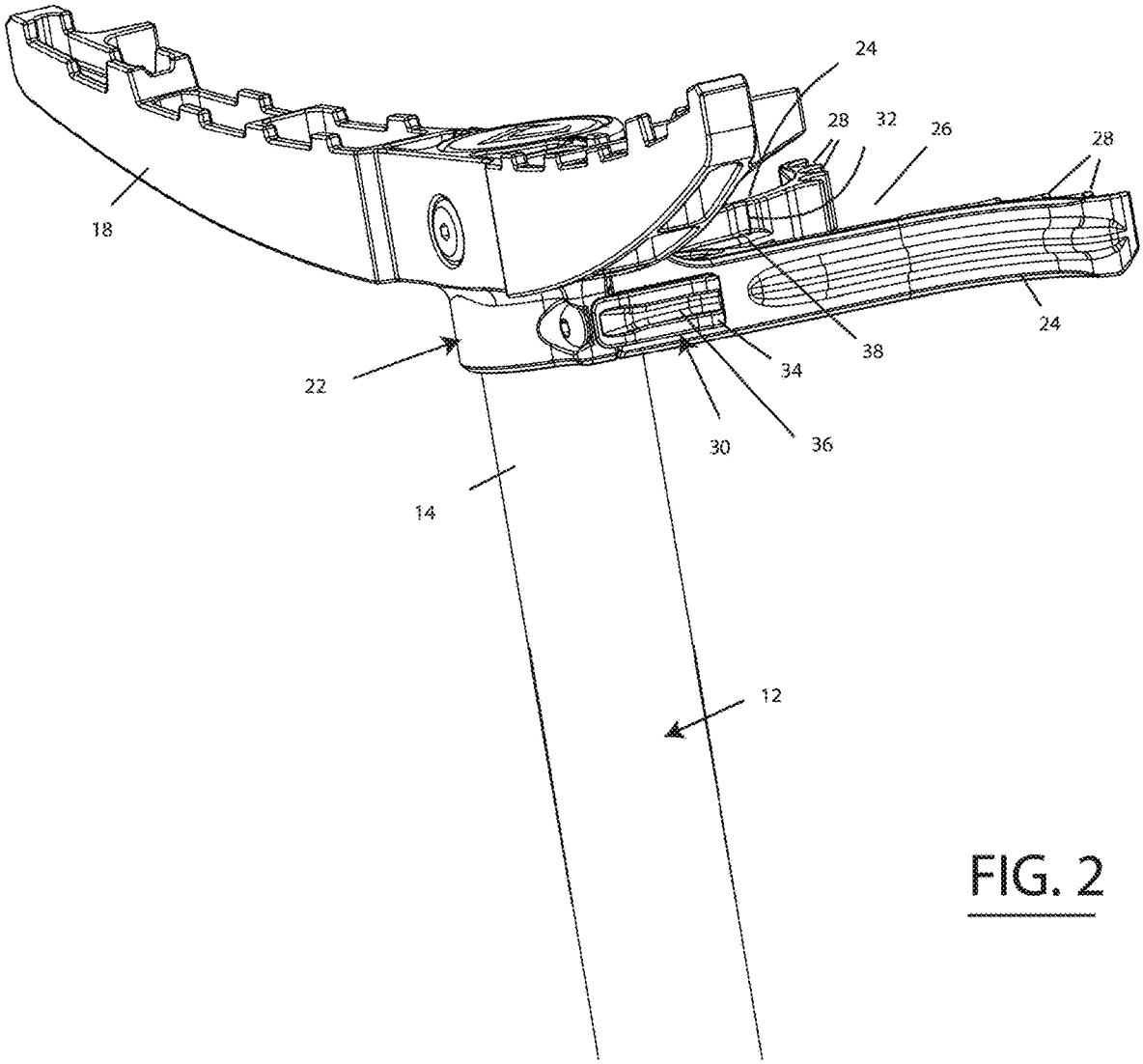
FIG. 2 is an enlarged fragmentary view of an upper portion of the stick.
Figure 3:
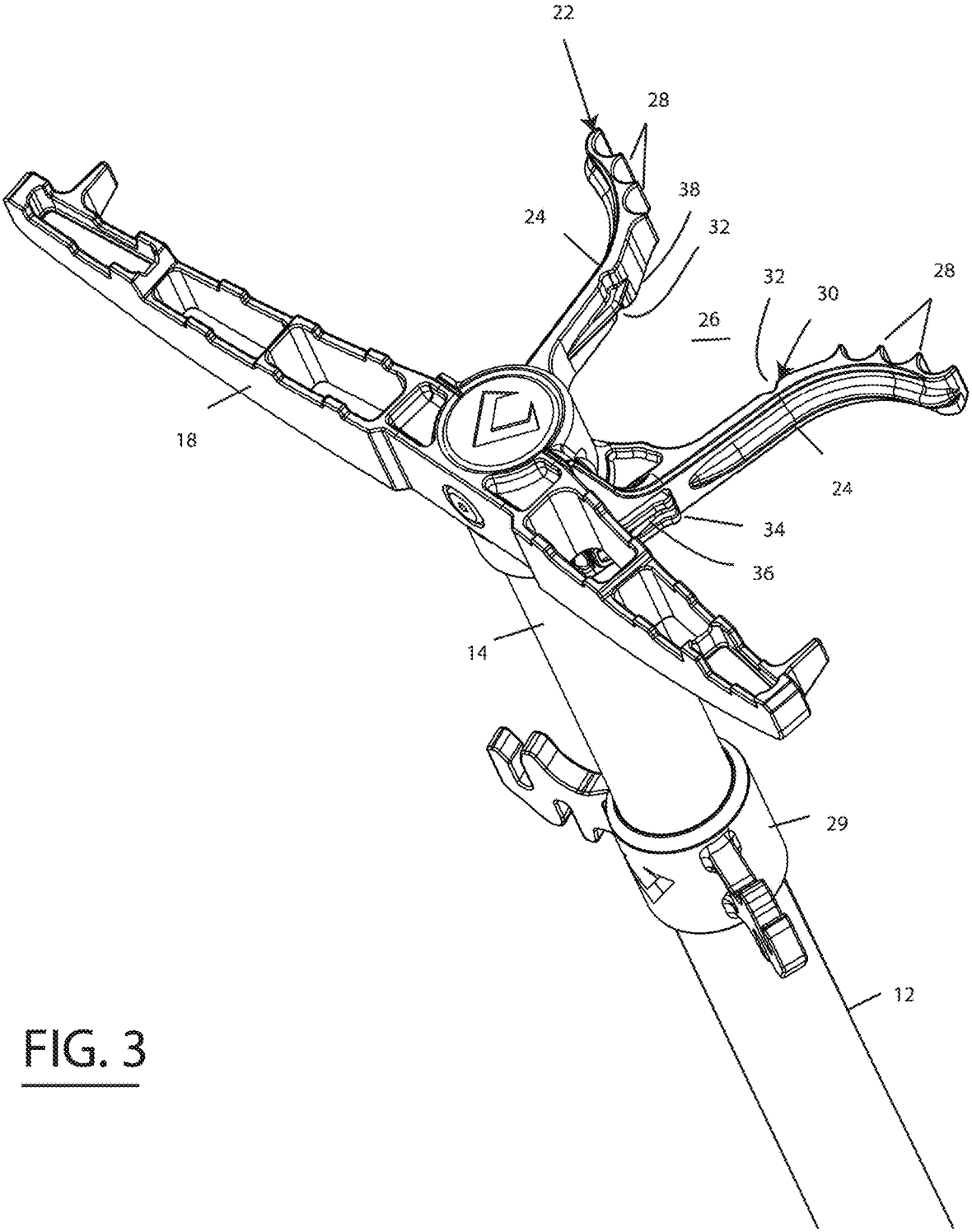
FIG. 3 is another enlarged fragmentary view of the upper portion of the stick.
Figure 4:
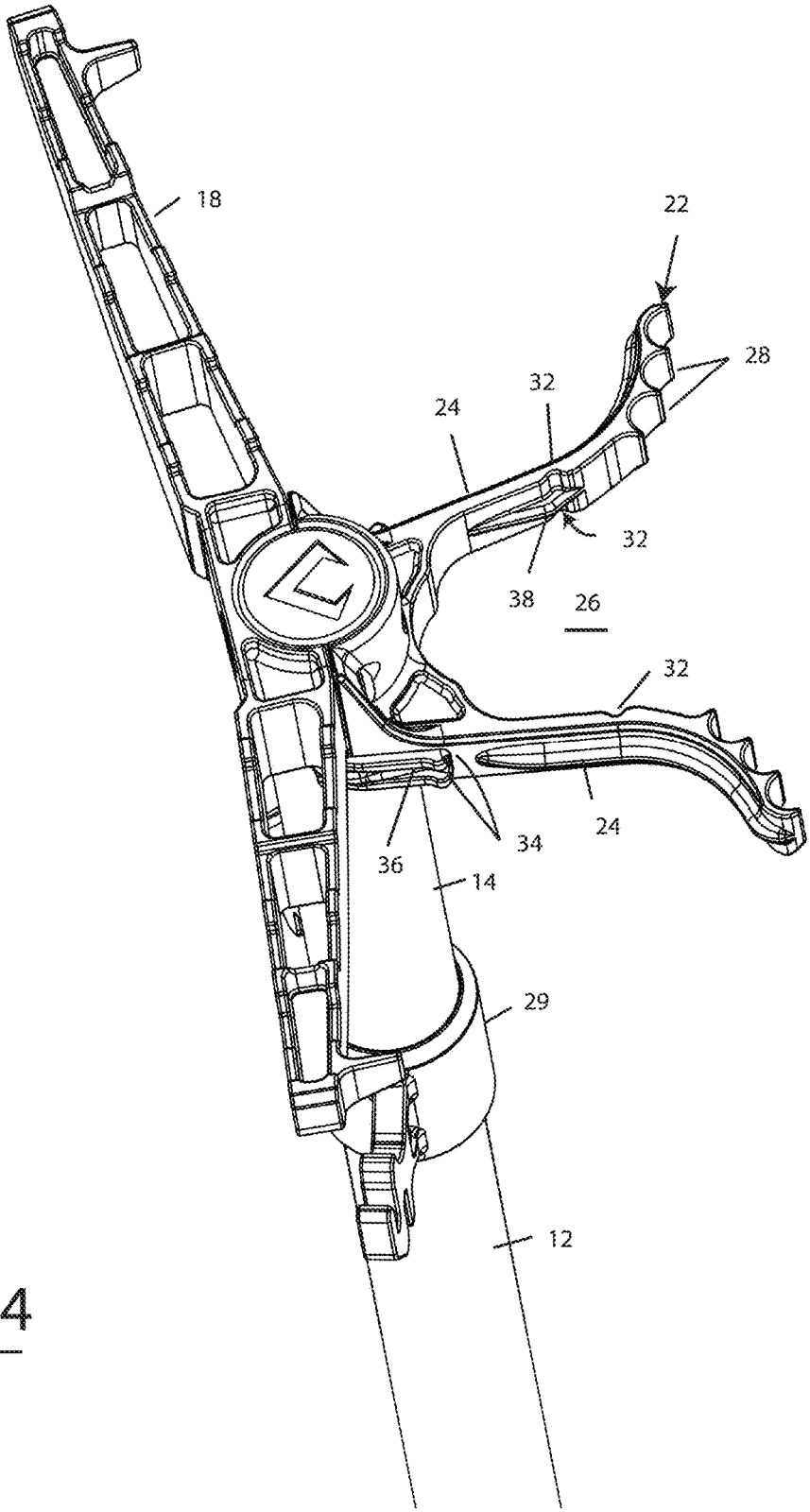
FIG. 4 is another enlarged fragmentary view of the upper portion of the stick.

The following detailed description provides illustrative embodiments of the disclosed subject matter, which pertains to tree-climbing sticks designed for compact, in-line stackability and secure nesting. The disclosed subject matter is generally directed to portable climbing aids used by hunters, particularly saddle hunters, as well as outdoor enthusiasts, and others requiring elevated access in wooded environments. While specific for clarity and are not to be construed as limiting the scope of the disclosed subject matter.

Certain widely recognized features, processes, or components may be omitted or simplified to ensure clarity regarding the novel aspects of the described subject matter. Additionally, various modifications, substitutions, or rearrangements of the described elements are considered and may be implemented without deviating from the spirit and scope of the subject matter as defined by the appended claims. The embodiments described herein are intended to demonstrate the principles of the subject matter and do not represent all possible implementations.

The following description sets forth illustrative embodiments of tree-climbing sticks 10 configured for compact, in-line stacking and secure, releasable nesting. With initial reference to FIGS. 1-4, each stick 10 includes an elongated central post 12 extending along a longitudinal axis between an upper end 14 and a lower end 16. The post may be fabricated of a structural material such as tubular aluminum, titanium, magnesium, steel, composite plastics, carbon fiber, or other suitable material and constructions known to the art. An upper step 18 is fixed to the post 12 adjacent the upper end 14 and a lower step 20 is fixed to the post 12 adjacent the lower end 16. The steps 18, 20 may be made of a strong rigid material such as aluminum and may be secured to the post by suitable fasteners or the like. Upper and lower standoff brackets 22 are mounted to the post 12 near the upper and lower ends 14, 16 of the post 12 and preferably in position immediately below the upper and lower steps 18, 20. The upper and lower standoff brackets 22 may made of a strong rigid material such as aluminum and may be secured to the post 12 by suitable fasteners. The upper and lower steps 18, 20 and upper and lower standoffs 22 can be identical in construction. Each standoff bracket 22 includes a pair of laterally spaced jaws 24 that extend rearward from the post 12 to engage a tree trunk during use and define a recess 26 therebetween sized to cradle the trunk and stabilize the stick 10. The jaws 24 may include serrations or teeth 28 on their tree-facing surfaces to increase grip and reduce slippage under load for added stability of the stick 10. A rope or strap cleat 29 may be fixed to the post 12 between the upper and lower steps 18, 20, preferably closer to the upper step 18. The cleat 29 preferably projects laterally with minimal forward or rearward extension so as not to interfere with in-line stacking, and it extends no farther forward or rearward than the upper step 18. In use, the stick 10 is secured to a tree by positioning the jaws 24 against the trunk, attaching a rope or strap to the cleat 29, wrapping the rope or strap around the trunk, and reattaching it to the cleat 29.

As illustrated with additional reference to FIGS. 5-9, multiple sticks are shown either in position to be connected or in a nested and locked condition. The multiple sticks are understood to be identical in construction so the description pertaining to one stick applies to all. For clarity, reference may be made to first, second and third sticks and they will be referenced by 10, 10' and 10". Like features of the sticks will be referenced by the same reference numeral but primed or double primed for the second and third sticks 10', 10". It will be understood that any features described for one stick are contained in all other sticks even if not specifically described.

The standoff brackets 22 are dimensioned and shaped to nest with corresponding standoff brackets 22', 22" of the other sticks 10', 10" when not in use so that, when two or three or more sticks are coupled, their posts are disposed in substantial longitudinal alignment and their steps are likewise longitudinally aligned without increasing the effective end-to-end length of the assembly beyond that of an individual stick. The jaws of one stick are sized to accept or interleave with the jaws of another stick of like kind with minimal lateral spacing between the adjacent posts. Multiple sticks of like kind can be stacked in this way. In some embodiments, the spacing between nested posts is selected to be just sufficient to avoid mechanical interference between the steps of adjacent sticks while maintaining a low-profile, compact stack thickness. The result is a nested pair or a multi-stick stack of sticks that presents a streamlined, packable configuration well suited for transport through wooded terrain.

Figure 7:
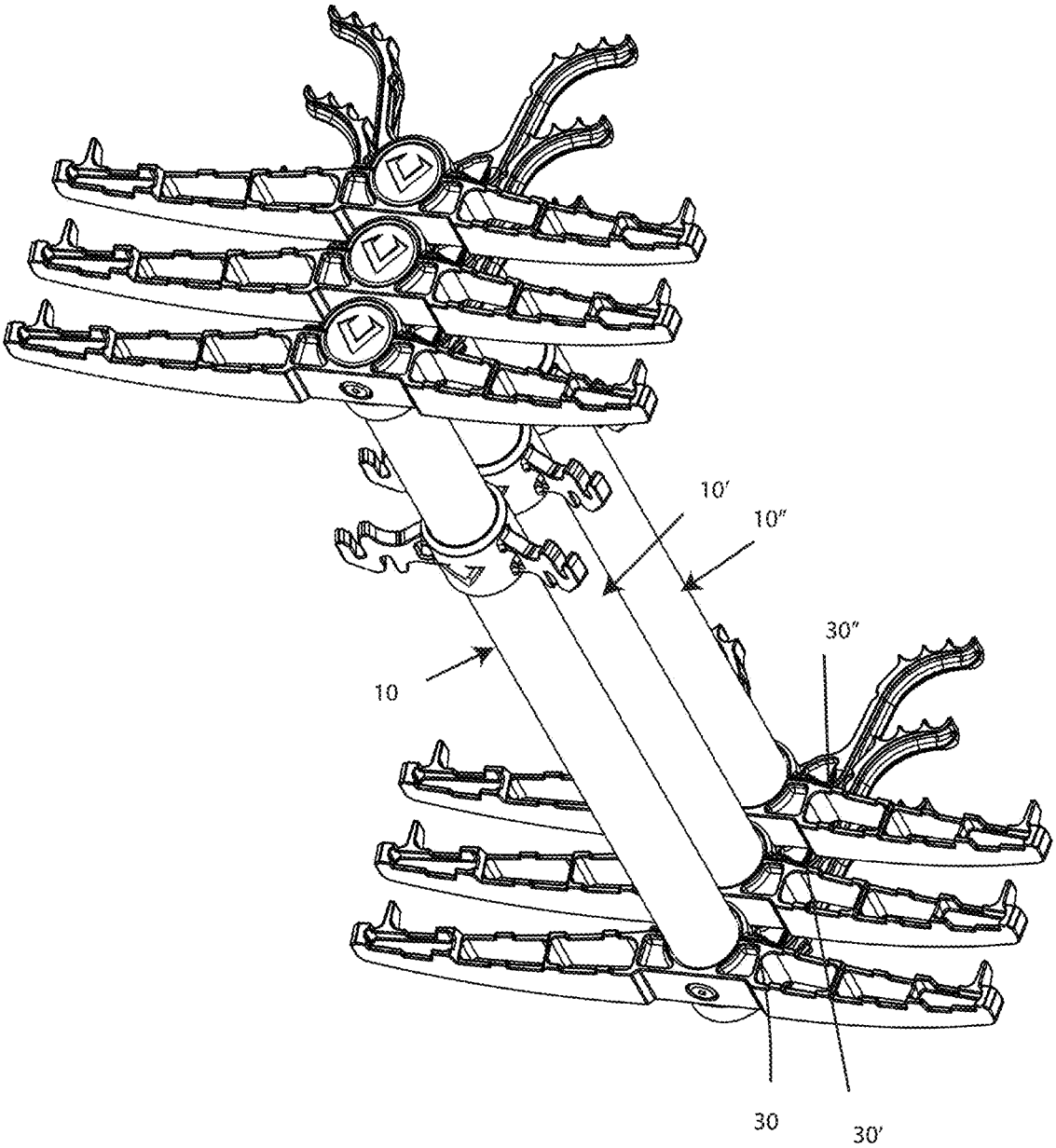
FIG. 7 is a perspective view of multiple sticks coupled together.
Figure 8:
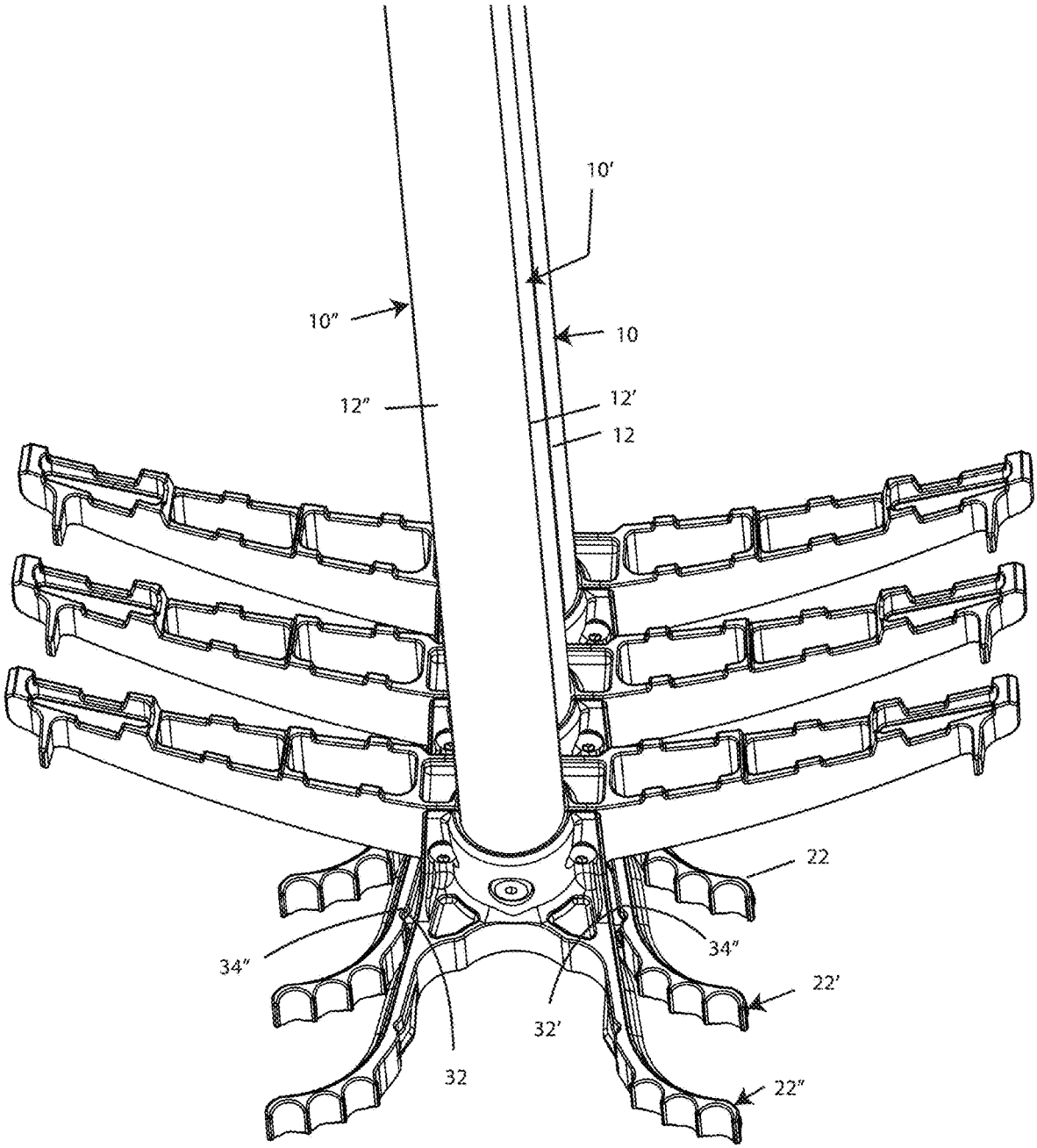
FIG. 8 is a fragmentary rear perspective view of the coupled sticks.
Figure 9:
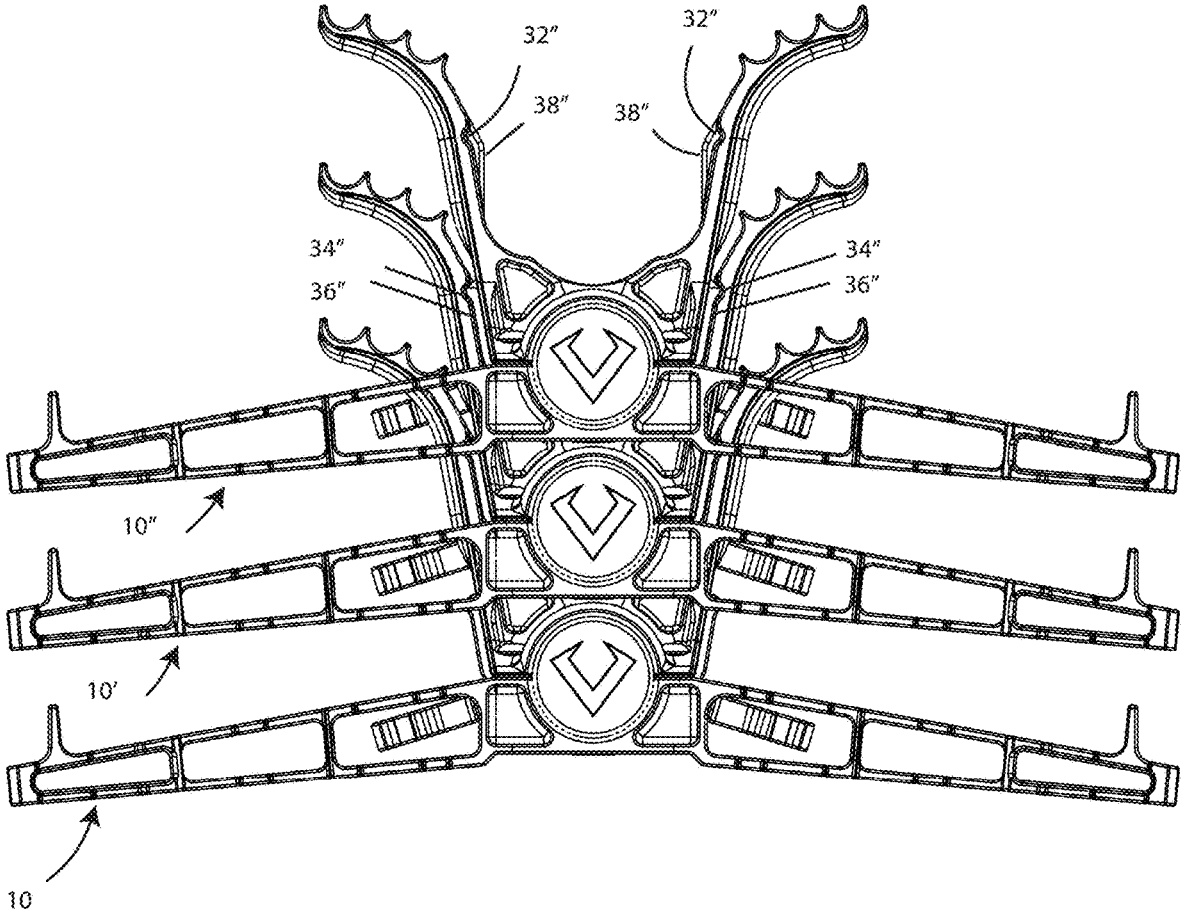
FIG. 9 is a top view of the coupled sticks.

To enable adjacent sticks to releasably lock to one another in the nested condition, complementary linking features or formations 30 are disposed on the jaws 22 of at least one and preferably both of the upper and lower standoffs 20 of each stick. More specifically, each jaw 22 of a given stick 10 includes linking features 30 that enable connection with a like jaw of a second stick 10' and further permit a like jaw of a third stick 10' to connect to the same jaw. FIGS. 7-9 illustrate three like sticks 10, 10' and 10" connected together in such manner with the jaws of the middle stick 10 are connected by its linking features to the corresponding linking features of the corresponding jaws of the front 10' and back 10' sticks of like construction.

The linking features 30 include cooperating detents 32 and protrusions 34. At least one of the detent 32 and protrusion 34 is resilient such that, as the jaws of two sticks are brought together, the protrusion resiliently deflects past the detent, or vice versa, and then rebounds into releasable engagement. For example, the protrusion 34 may be formed as a resilient nub or button of compressible material, such as nylon or another tough, wear-resistant, elastically yieldable plastic, and is preferably carried on each jaw of the upper and lower standoff. In one embodiment, a pair of protrusions 34 are disposed on the outer-facing side of each jaw 24 adjacent laterally opposite sides of the post 12 and are secured by overmolding the elastically yieldable material onto the jaw structure. The detent 32 may be formed of a rigid, non-yielding feature of the jaw structure. In one embodiment, a pair of detents 32 are provided on the inner-facing side of each jaw 24 facing the recess 26. The relative positions and geometries of the detents 32 and protrusions 34, including draft angles, radii, and interference at the point of engagement, may be selected to provide a secure retention force resisting lateral separation while still permitting intentional disconnection by pulling the sticks apart in a direction opposite the insertion direction.

To further facilitate reliable assembly of adjoining sticks, the complementary linking features 30 on each jaw 24 can include alignment aids such as cooperating guiding channels 36 and guiding ribs 38. The guiding channels 36 may be provided on the outer-facing side of each jaw 24 adjacent the protrusions 34 and may be formed of the same elastically resilient material and preferably overmolded as one piece with the protrusions 34 of the same material. The guide ribs 38 may be provided on the inner-facing side of the jaws 24 adjacent the detents 32 and may be formed of as an integral contour of the rigid jaw material. The guide channels 36 and guide ribs 38 preferably extend forward in line with their respective adjacent protrusions 34 and detents 36 and are aligned to direct the protrusions 34 of one stick toward engagement with the detent 36 of an adjacent stick. In one embodiment, the guide channels 36 extend through the protrusions 34 so that each protrusion 34 on the jaw 24 is bifurcated by its associated guide channel 36. Likewise, the guide ribs 38 may extend through the detents 32 so that each detent 32 on the jaw 24 is bifurcated by its associated guide rib 38. During nesting of adjacent sticks 10, 10', the guide ribs 38 of one stick 10 enter the associated guide channels 36 of the other stick 10' before the protrusion reaches the detent, thereby constraining relative motion and aligning the protrusion with the detent for a positive, repeatable interengagement. In preferred forms, the guiding ribs 38 and channels 36 extend along at least a portion of the depth of insertion so that lateral and rotational misalignment of the sticks 10, 10' is reduced, and a snap-fit occurs between the protrusions and detents with consistent force and feel. The guiding elements may also reduce rattling or noise by providing surface frictional contact over a broader area. The overmolded resilient material of the channel 36 and protrusion 34 also contribute as a dampening material to further help reduce rattling and noise of the nested sticks 10. 10'.

In preferred embodiments, both the upper and lower standoff brackets 22 incorporate the complementary linking features 30 so that both ends of mating sticks 10, 10' can be used to couple nesting sticks. Providing linking features at both standoffs enhances alignment of the nesting sticks and increases engagement strength and integrity, particularly in multi-stick stacks where the top stick's connection to the adjacent stick must be sufficiently robust to bear the weight of the entire stack.

The standoff brackets 22 and their jaws 24 may be fabricated from rigid metal, polymer, composite, or combinations thereof. In one configuration, the brackets 22 and jaws 24 are aluminum for structural rigidity, while the protrusion 34 and/or detent 32 and channels 36 are provided as an overmolded, bonded, or mechanically captured polymeric insert to provide resilience, quiet operation, and reduced wear. Suitable materials for resilient features include nylon, acetal, polyurethane, thermoplastic elastomers, and fiber-reinforced variants. The resilient element can be configured with a thickness, length, and modulus selected to yield a desired insertion force, retention force, and tactile or audible indication of engagement. For example, the protrusions may produce a perceptible haptic click feel when they seat in the recess, providing user feedback that the sticks are securely connected. The ribs 38 and channels 36 may likewise provide controlled resistance during engagement, giving the user a tactile sense of guided movement and a soft yet solid connection between the sticks. It will be appreciated that the locations and materials of the detents 32 and protrusions 34 may be reversed, as may the channels 36 and ribs 38.

Figure 5:
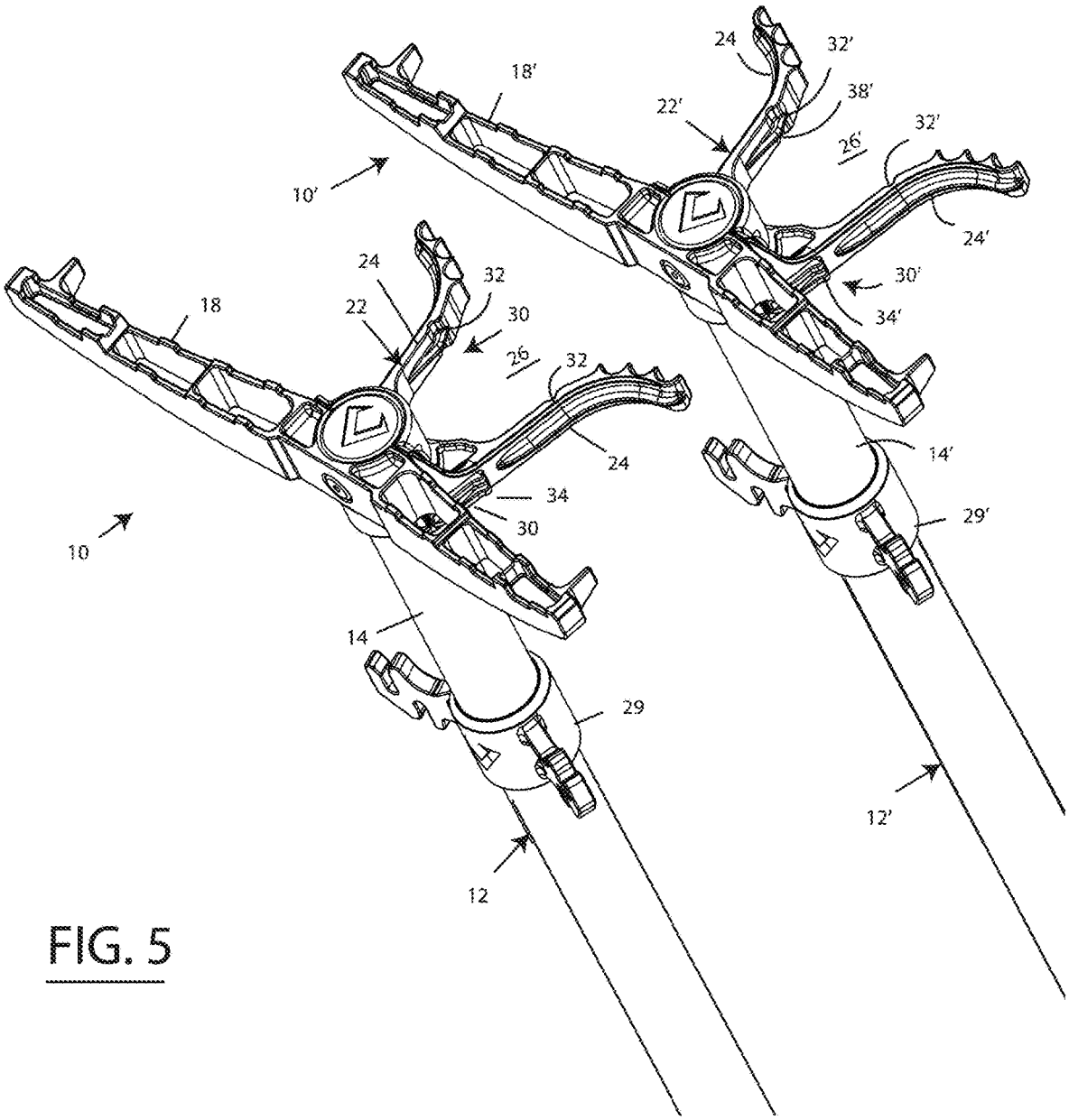
FIG. 5 is an enlarged fragmentary view of two sticks in positioned to be coupled.
Figure 6:
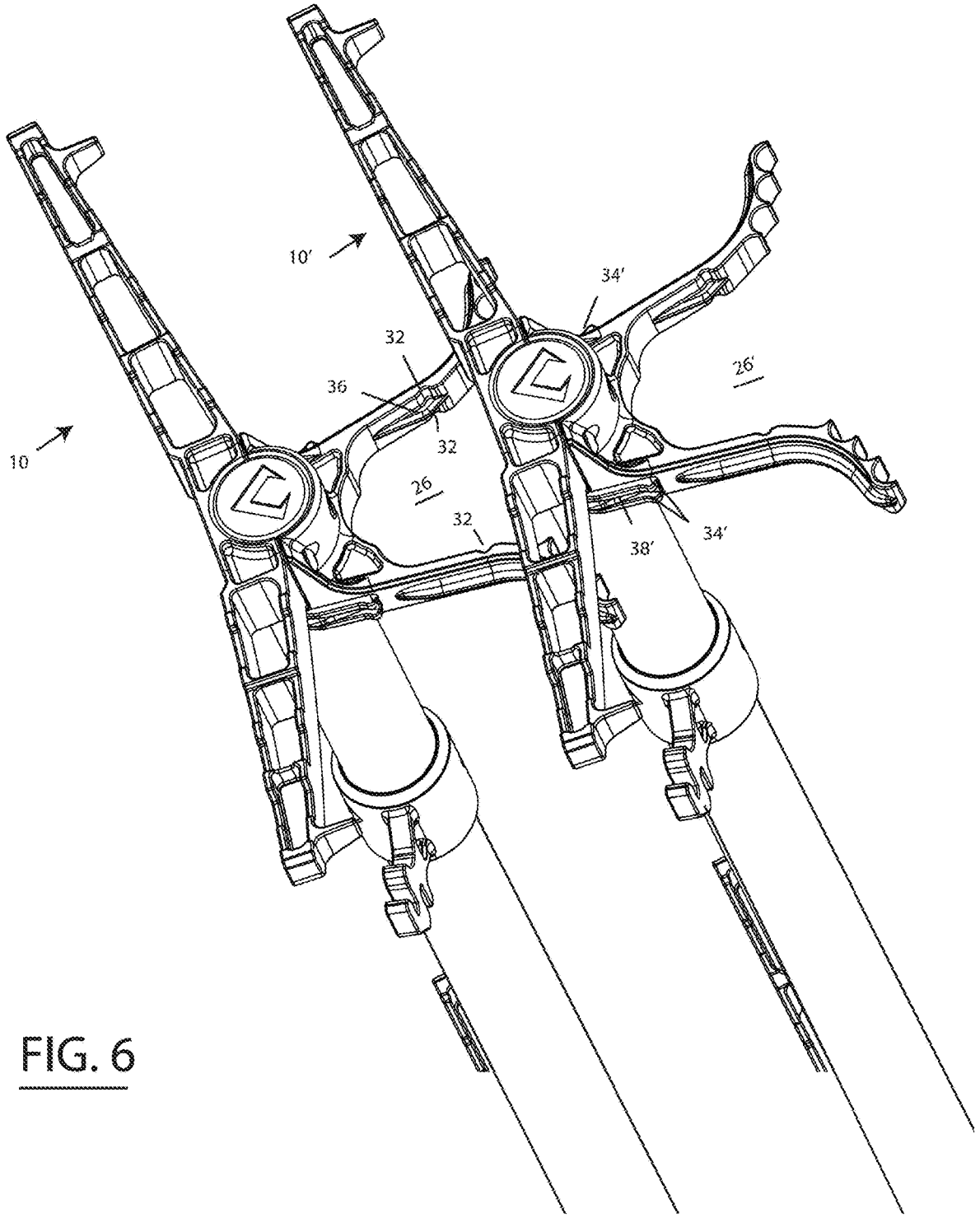
FIG. 6 is another enlarged fragmentary view the two sticks.

In use, a first stick 10 is oriented with the jaws 24 of one of its standoff brackets 22 facing laterally outward to receive the jaws 22' of a second stick 10', as illustrated best in FIGS. 5 and 6. The user advances the second stick 10' laterally so that its jaws 22' are inserted between the jaws 22 of the first stick 10 until the complementary linking features 30, 30' releasably interengage, thereby detachably securing the sticks 10. 10' together in the nested condition with the posts 12, 12' and steps 18, 20; 18', 20' in substantial longitudinal alignment. The guiding ribs 38' of the second stick 10' are received in the guiding channel 36 of the first stick 10 to direct and guide the jaws 22, 22' into proper register prior to engagement of the protrusions 34 of the first stick with the detents 32' of the second stick 10'. This process can be repeated with additional sticks to form a compact, in-line stack, with each adjacent pair releasably locked together by their interengaged linking features. FIGS. 6-9 illustrate a stack of three sticks 10, 10' and 10" locked together. Four or more sticks in a multi-stick stack are possible and contemplated. The nested condition constrains adjacent sticks against relative lateral displacement transverse to the longitudinal axes of their posts, yet permits disengagement upon application of a predetermined release force in the reverse direction. The lateral nested ribs 38 and channels 36 additionally constrains the nested sticks against relative longitudinal movement so the nested stack has a solid feel with no relative movement or rattling of the sticks in any direction. The magnitude of the release force can be engineered by selecting the geometry and material properties of the resilient element and detent.

The interengaged sticks can be carried as a single, compact unit without external straps or carriers dedicated solely to connection, thereby reducing weight, bulk, and noise. Because the sticks stack in-line with the ends of their posts aligned, the effective end-to-end length of the assembly remains the same or substantially the same as that of an individual stick, which improves packability and maneuverability. The standoff brackets 22 are advantageously configured not only to support the sticks on a tree during climbing but also to provide the nesting and locking functions, eliminating the need for separate connectors whose sole purpose is to couple sticks together.

While the foregoing description illustrates exemplary configurations of the complementary linking features as a detent and a cooperating protrusion with preferred guiding channels and ribs, numerous variations are possible. The detent can be positioned on either an inner or outer surface of a jaw, with the protrusion located on the corresponding opposing surface of the mating jaw. The same is true of the guide channels and ribs. Multiple detents and protrusions can be used to increase the holding force or to provide redundant connection. The jaw could be rigid and the detent resilient.

It will be understood that the described structures and methods can be implemented on tree-climbing sticks of various lengths, step configurations, and materials. The linking features can be integrated into newly manufactured standoff brackets or provided as retrofit components affixed to existing brackets, provided that the resulting geometry maintains the nesting and alignment described. The methods of preparing sticks for transport encompass manual or tool-assisted engagement, with the sequence of orientations and the selection of upper or lower standoffs being at the user's discretion. Many modifications and variations are possible in view of the above teachings, and all such alternatives that fall within the scope of the appended claims are intended to be encompassed by this description.

Obviously, many modifications and variations of the present invention are possible in light of the above teachings. It is, therefore, to be understood that the invention may be practiced otherwise than as specifically described while still being within the scope of the invention. The invention is defined by the claims.

What is claimed is:

1. A tree-climbing stick comprising:

post extending longitudinally between an upper end and a lower end;

an upper step fixed to the post adjacent the upper end;

a lower step fixed to the post adjacent the lower end;

an upper standoff bracket secured to the post adjacent the upper end and having laterally spaced jaws configured to cradle a portion of a tree trunk in use;

a lower standoff bracket secured to the post adjacent the lower end and having laterally spaced jaws configured to cradle a portion of a tree trunk in use;

the upper and lower standoff brackets being dimensioned to nest with corresponding standoff brackets of a second, identical stick so that the posts and steps of the nested sticks are disposed in substantial longitudinal alignment; and complementary linking features carried by the jaws of at least one of the upper and lower standoff brackets and configured to releasably interengage with complementary linking features of the second, identical stick in response to relative movement of the sticks into nested relation to thereby releasably lock the sticks together against reverse separation.

2. The tree-climbing stick of claim 1, wherein the complementary linking features comprise:

at least one detent on at least one of an inner or outer facing surface of the jaws; and at least one cooperating protrusion on at least the other of the inner or outer facing surface of the jaws, at least one of the detent and the protrusion being resilient so that, when the jaws of two sticks are nested, the at least one protrusion resiliently deflects past and then releasably engages the at least one detent to detachably lock the sticks together.

3. The tree-climbing stick of claim 2, wherein the complementary linking features further include:

at least one guiding rib on one of the inner or outer facing surfaces of the jaws; and a cooperating guiding channel on the other of the inner or outer facing surfaces of the jaws, the at least one guiding rib being received in the at least one guiding channel during nesting to align the at least one protrusion with the at least one detent.

4. The tree-climbing stick of claim 3, wherein each upper and lower standoff bracket includes a pair of detents on an inward facing surface of its jaws and a pair of protrusions on an outward facing surface of the jaws.

5. The tree-climbing stick of claim 4, wherein the inward facing surface includes the at least one guiding rib and the outward facing surface includes the at least one guiding channel.

6. The tree-climbing stick of claim 1, wherein the jaws of both the upper standoff and lower standoff brackets incorporate the complementary linking features.

7. A method of preparing a plurality of tree-climbing sticks for transport, each stick including a post extending longitudinally between upper end and a lower end, an upper step and a lower step fixed to the post, and upper and lower standoff brackets mounted on the post, each standoff bracket including a pair of laterally spaced jaws carrying complementary releasably interengageable linking formations, the method comprising:

positioning a first stick of the plurality of tree-climbing sticks with the jaws of one of the standoff brackets oriented to receive the jaws of a second stick of the plurality of tree-climbing sticks and moving the sticks relative to one another into nested relation until the linking formations of the two sticks releasably interengage to thereby releasably lock the first stick and the second stick together against reverse separation in a nested condition in which the upper and lower ends of the posts and the steps of the nested sticks are disposed in substantial longitudinal alignment.

8. The method of claim 7, further comprising repeating the positioning and moving steps with additional sticks so that the sticks become releasably locked together in a compact stack with their posts and steps disposed in substantial longitudinal alignment.

9. The method of claim 8, wherein the linking formations comprise complementary detents and protrusions.

10. The method of claim 9, further comprising guiding the jaws of the second stick toward the jaws of the first stick during relative movement of the sticks into nested relation by inserting a guiding rib on one of the jaws into a cooperating guiding channel on the other jaw prior to engagement of a protrusion on one of the jaws with a cooperating detent on the other jaw.

* * * * *